US012702257B2

(12) United States Patent
Holloway

(10) Patent No.: US 12,702,257 B2
(45) Date of Patent: Aug. 11, 2026

(54) HAND CLEANING TOOL INCLUDING INDIVIDUAL FINGER SCRAPERS

(71) Applicant: Ernestine Holloway, Santee, CA (US)

(72) Inventor: Ernestine Holloway, Santee, CA (US)

( * ) Notice: Subject to any disclaimer, the term of this patent is extended or adjusted under 35 U.S.C. 154(b) by 390 days.

(21) Appl. No.: 18/237,344

(22) Filed: Aug. 23, 2023

(65) Prior Publication Data

US 2025/0064272 A1 Feb. 27, 2025

(51) Int. Cl.
*A47K 7/00* (2006.01)

(52) U.S. Cl.
CPC ..... *A47K 7/00* (2013.01)

(58) Field of Classification Search
CPC ..... A47K 7/00; A47L 13/08; B44D 3/006
USPC ..... 15/236.07, 236.06, 236.05, 236.03, 15/236.01; D32/46, 41
See application file for complete search history.

(56) References Cited

U.S. PATENT DOCUMENTS 2,562,136 A * 7/1951 Sullins ..... H01M 50/543 D8/90
D169,837 S * 6/1953 Blander ..... D32/46
2,646,581 A * 7/1953 Nelson ..... A47L 13/08 30/169
D267,281 S * 12/1982 Mottl ..... D32/46
D459,042 S * 6/2002 Carew ..... D32/46
7,845,077 B1 * 12/2010 Alulis ..... A44C 9/02 264/296

* cited by examiner

*Primary Examiner* — Tom Rodgers
(74) *Attorney, Agent, or Firm* — Fenwick & West LLP

(57) ABSTRACT

A hand cleaning tool for the kitchen is described. The hand cleaning tool includes a tool body, a number of connection points, and a number of finger scrapers. Each of the finger scrapers is connected to the tool body at one of the connection points. Each of the finger scrapers is shaped to form a partial annulus. Each partial annulus includes an inner surface disposed at an inner radius from a center of the partial annulus, an outer surface disposed at an outer radius from the center of the partial annulus, and a finger scraper body formed between the inner surface and the outer surface and forming an arc of the partial annulus. The finger scraper body is coupled to a connection point of the plurality at a midpoint of the arc along the outer surface. The finger scrapers may be removably couplable from the tool body at a coupling joint.

9 Claims, 19 Drawing Sheets

Hand Cleaning Tool
100

HAND CLEANING TOOL INCLUDING INDIVIDUAL FINGER SCRAPERS

TECHNICAL FIELD

The described subject matter generally relates to kitchen and cooking tools, and, in particular, to a kitchen and cooking tool to aid in cleaning a person's hands.

BACKGROUND

Cooking various dishes in the kitchen can be messy affairs for the chef's hands. For example, making a meatloaf leaves the chef's hands covered in ground beef, making cookies leaves the chef's hands covered in cookie dough, etc. In this situation, the chef does not have many ways of cleaning their hands without losing part of the dish they are preparing. For instance, the chef may wipe the cookie dough off of their hands, or may wash the ground beef off of their hands. In either case, the chef loses part of the dish. As such, a kitchen tool that allows a chef to clean their hands and fingers without wasting material would be useful.

SUMMARY

In some aspects, the techniques described herein relate to a hand cleaning tool including: a tool body; a plurality of connection points; a plurality of finger scrapers, each finger scraper of the plurality connected to the tool body at one of the plurality of connection points, and shaped to form a partial annulus, each partial annulus including: an inner surface disposed at an inner radius from a center of the partial annulus, the inner radius at least 4 cm, an outer surface disposed at an outer radius from the center of the partial annulus, a finger scraper body formed between the inner surface and the outer surface and forming an arc of the partial annulus, wherein the arc of the partial annulus is at least 180 degrees, and the finger scraper body is coupled to a connection point of the plurality at a midpoint of the arc along the outer surface.

In some aspects, the techniques described herein relate to a hand cleaning tool, wherein the tool body includes: a top surface; a bottom surface; and one or more side surfaces connecting the top surface to the bottom surface. Additionally, each connection point of the plurality of connection points may be disposed at a midpoint of a side surface of the one or more side surfaces.

In some aspects, the techniques described herein relate to a hand cleaning tool, wherein the tool body includes a beveled edge. The tool body may be any of a square, a rectangle, or a quadrilateral.

In some aspects, the techniques described herein relate to a hand cleaning tool, wherein a thickness of the tool body is at least 3 mm. Similarly, a thickness of the tool body may be between 1 mm and 4 mm. An inner radius of the partial annulus of each finger scraper of the plurality of finger scrapers may be between 3 mm and 6 mm. The inner radius of a first finger scraper of the plurality of finger scrapers may be different a different radius than the inner radius of a second finger scraper of the plurality of finger scrapers.

In some aspects, the techniques described herein relate to a hand cleaning tool, wherein the arc of a first finger scraper of the plurality of finger scrapers is a different arc than the arc of a second finger scraper of the plurality of finger scrapers. The arc of the partial annulus of each finger scraper of the plurality of finger scrapers may be between 90 degrees and 330 degrees.

In some aspects, the techniques described herein relate to a hand cleaning tool, wherein an extended connection point of the plurality of connection points includes an extension member, the extension member formed to extend the connection point away from the tool body. A finger scraper of the plurality of finger scrapers may be connected to the extension member of the extended connection point of the plurality of connection points.

In some aspects, the techniques described herein relate to a hand cleaning tool, the plurality of finger scrapers are removably couplable from the tool body at the plurality of connection points. The plurality of connection points and the plurality of connection points may form a coupling joint.

The figures depict various embodiments for purposes of illustration only. One skilled in the art will readily recognize from the following discussion that alternative embodiments of the structures and methods illustrated herein may be employed without departing from the principles described herein.

DETAILED DESCRIPTION

I. Introduction

Cooking various dishes in the kitchen can be a messy affair for the chef's hands. For example, making a meatloaf leaves the chef's hands covered in ground beef, making cookies leaves the chef's hands covered in cookie dough, etc. In this situation, the chef does not have many ways of cleaning their hands and fingers without losing part of the dish they are preparing. For instance, the chef may wipe the cookie dough off of their hands or may wash the ground beef off of their hands. In either case, the chef loses part of the dish.

The hand cleaning tool described herein provides these chefs some reprieve. The hand cleaning tool is formed to allow a chef to remove excess parts of the dish that have adhered to their fingers without losing those portions of the dish. That is, for example, the chef could use the hand cleaning tool to remove the cookie dough from their hands, or, similarly, ground beef, and place it back into the bowl.

II Hand Cleaning Tool

Figure 1:
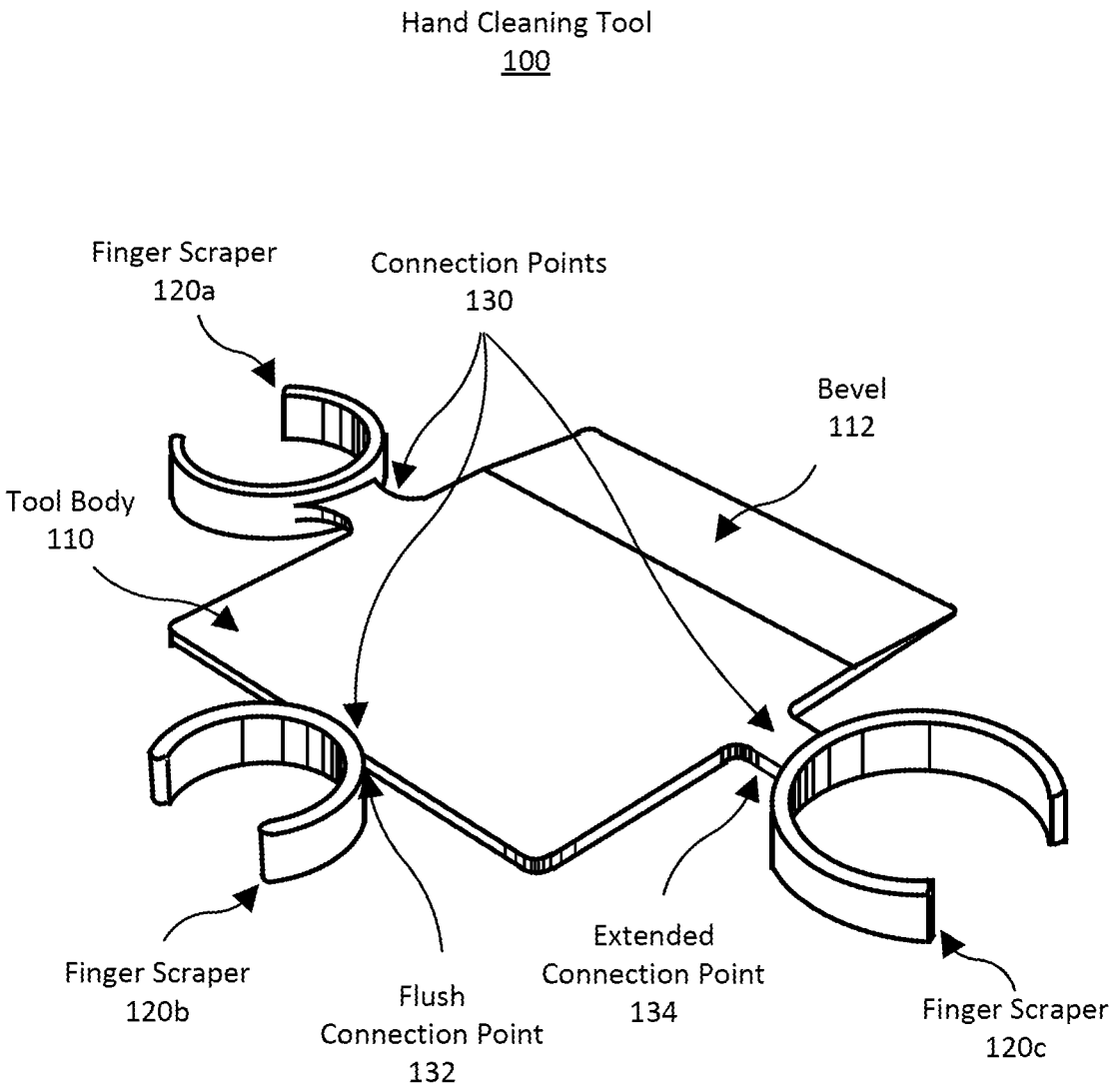
FIG. 1 illustrates an isometric view of a hand cleaning tool, in accordance with an example embodiment.

FIG. 1 illustrates an isometric view of a hand cleaning tool 100, according to one example embodiment. As described above, the hand cleaning tool 100 is used to clear a user's fingers of detritus during kitchen activities such as, e.g., baking cookies or making meatloaf. The hand cleaning tool 100 includes a tool body 110 ("tool body") and a number of finger scrapers 120 (e.g., finger scraper 120*a*, 120*b*, 120*c*). The finger scrapers 120 are connected to the tool body 110 at connection points 130. The connection points 130 may be flush connection points 132 or extended connection points 134. The tool body 110 may include a bevel 112 to allow for easier removal of detritus from a user's hands.

Tool Body

The tool body 110, in one configuration, is approximately shaped as a rectangular prism. Thus, the tool body 110 includes top surface and a bottom surface. The tool body 110 also includes a left side, a right side, a front side, and a back side (in the aggregate, "body sides"). The top surface is connected to the bottom surface by the body sides such that the tool body 110 has a body thickness. The tool body 110 may therefore be a square, a rectangle, or some other quadrilateral. Further, the tool body 110 is not limited to four sided shapes and may be, for example, a circle, an oval, a triangle, a five-sided shape, or some other geometric shape.

In various example configurations, the body sides have a length between 3 cm and 30 cm, but could have other lengths. Additionally, any number of the body sides may be the same length, or any number of the body sides may be different lengths. For example, the left and right side may be 6 cm, while the front side and back side may be 4 cm. In another example, the front side may be 5 cm, the back side may be 8 cm, and the left and ride side may be 4 cm.

In various example configurations, the body thickness may be between 1 mm and 15 mm, but could be other thicknesses. For example, the body thickness may be 3 mm, or the body thickness may be 5 mm. Additionally, in various example configurations, the tool body 110 may include a bevel 112 such that the body thickness of the tool body 110 is not uniform. For instance, the bevel may extend from approximately a midpoint of the tool body 110 to, e.g., a back side of the tool body 110 such that the body thickness at the midpoint of the tool body 110 is 5 mm while the body thickness at the back side is 3 mm.

The tool body 110 is formed of one or more tool body materials. The tool body materials may be, for example, a plastic such as polyethylene, vinyl, or polyethylene terephthalate, a metal such as aluminum or stainless steel, a ceramic, a wood, or some other suitable material. In some examples, the tool body 110 includes several materials. For instance, the tool body 110 may include both metal and plastic, or may include both ceramic and wood.

Finger Scrapers

The hand cleaning tool 100 includes various finger scrapers 120. A user of the hand cleaning tool 100 slides their fingers along an inner surface of the finger scraper 120 and detritus on the user's fingers is removed. Removing the detritus may include either removing the detritus from the user's hands or transferring the detritus to the hand cleaning tool 100. When the latter occurs, the detritus can easily be removed from the hand cleaning tool 100 by, for example, tapping the tool against a bowl or wiping the hand cleaning tool 100 with a cloth or napkin.

Each finger scraper 120 of the hand cleaning tool 100 forms a partial annulus. The partial annulus includes a top surface and a bottom surface. The top surface is connected to the bottom surface by an inner surface, an outer surface, and two end surfaces such that the finger scraper 120 has a scraper thickness. The inner surface of the partial annulus follows the inner radius of the partial annulus (measured from a center of the partial annulus), and the outer surface follows the outer radius of the partial annulus (measured from the center of the partial annulus). The difference between the inner radius and the outer radius is a wall thickness. Finally, a partial annulus spans an arc, where the arc is a measure of the "completeness" of the partial annulus. For instance, an arc of 90 degrees indicates one quarter of a circular partial annulus, an arc of 180 degrees indicates one half of a circular partial annulus, etc.

In various example configurations, the scraper thickness is between 1 mm and 15 mm. The scraper thickness may be the same or different from the body thickness. For instance, in an example, the scraper thickness may be 8 mm while the body thickness is 5 mm.

In various example configurations, the inner radius is between 3 mm and 20 mm, and the outer radius is between 4 mm and 21 mm, but other radii are possible. The wall thickness may be between 1 mm ant 5 mm. For example, the inner radius may be 5 mm and the outer radius may be 8 mm such that the wall thickness may be 3 mm. Additionally, each finger scraper 120 may have different radii. For instance, a first finger scraper 120*a* may include an inner radius of 4 mm and an out radius of 6 mm, while a second finger scraper 120*b* may include an inner radius of 6 mm and an outer radius of 8 mm.

In various example configurations, the finger scrapers 120 may have an arc between 60 degrees and 330 degrees. For example, a finger scraper 120 may have an arc of 225 degrees. Additionally, one or more of the finger scrapers 120 may have the same arc, and/or one or more of the finger scrapers 120 may have different arcs. For example, a first finger scraper 120*a* may have an arc of 225 degrees, while a second finger scraper 120*b* may have an arc of 260 degrees.

In various example configurations, the finger scrapers 120 may be formed of one or more scraper body materials. The scraper body materials may be, for example, a plastic such as polyethylene, vinyl, or polyethylene terephthalate, a metal such as aluminum or stainless steel, a ceramic, a wood, or some other suitable material. In some examples, the finger scrapers 120 includes several materials. For instance, the finger scrapers 120 may include both metal and plastic, or may include both ceramic and wood.

Connection Points

The hand cleaning tool 100 includes connection points 130. Connection points 130 are locations on the hand scraping tool where the finger scrapers 120 connect to the tool body 110. As described below, connection points 130 may allow for the finger scrapers 120 to be removably coupled to the tool body 110.

Connection points 130 can be positioned on the hand cleaning tool 100 in a variety of ways. For instance, in an example configuration, connection points 130 are disposed around the body sides such that the connection points approximately mirror the position of a user's fingers. In another example configuration, connection points 130 are disposed around the body sides such that they are approximately equidistant from one another. In another example configuration, connection points 130 may be disposed at approximately the midpoint of one or more body sides.

As disclosed above, finger scrapers 120 are coupled to the tool body 110 at connection points 130. Various positions or points of a finger scraper 120 can be connected to the tool body 110 at a connection point 130, depending on the configuration of the hand cleaning tool 100. For instance, in one configuration, a finger scraper 120 may be coupled to a connection point 130 at a midpoint of the finger scraper 120. That is, for a finger scraper 120 formed as a partial annulus, the midpoint connected to the connection point 130 is the midpoint of the arc on the outer surface of the finger scraper 120. In other examples, the finger scraper 120 may be coupled to a connection point 130 at other points, such as an end point of a finger scraper 120.

A connection point 130 may a flush connection point 132 or an extended connection point 134. A flush connection point 132 directly couples a finger scraper 120 to the tool body 110. An extended connection point 134 comprises an extension member that extends away from the tool body 110 and a finger scraper 120 couples to the extended connection point 130 at the end of the extension member.

A connection point 130 is typically formed from the same material as the tool body material and/or scraper body material. However, the connection point 130 may be formed from one or more connection materials 130 that are dissimilar from the body material or scraper material. The connection material may be, for example, a plastic such as polyethylene, vinyl, or polyethylene terephthalate, a metal such as aluminum or stainless steel, a ceramic, a wood, or some other suitable material. In some examples, the connection point 130 body includes several materials.

Additional Views

Figure 2A:
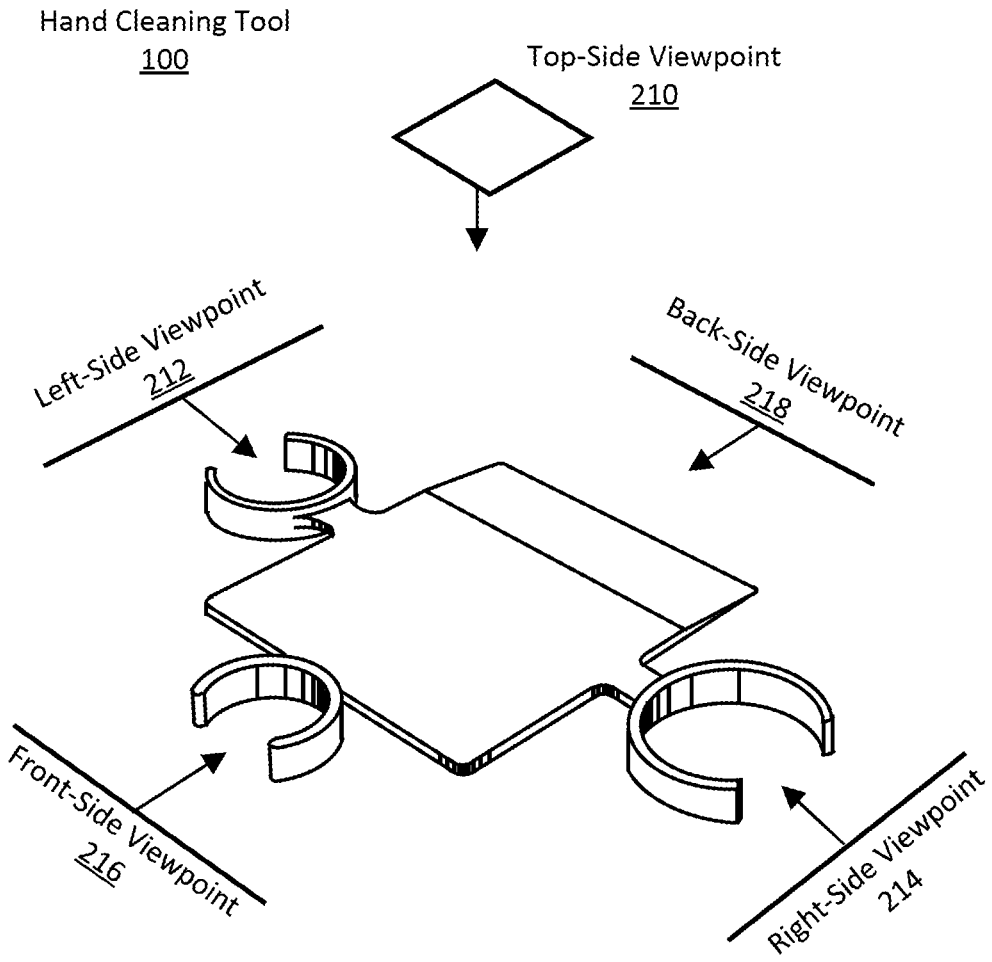
FIG. 2A illustrates the isometric view of the hand cleaning tool of FIG. 1A, but with additional viewpoints, in accordance with an example embodiment.

FIG. 2A illustrates the isometric view of the hand cleaning tool 100 of FIG. 1A with additional viewpoints, in accordance with an example embodiment. FIG. 2A includes a top-side viewpoint 210, a left-side viewpoint 212, a right-side viewpoint 214, a front-side viewpoint 216, and a back-side viewpoint 218 of the hand cleaning tool 100. FIGS. 2B-2F illustrate the hand cleaning tool 100 of FIG. 2A from the different viewpoints.

Figure 2B:
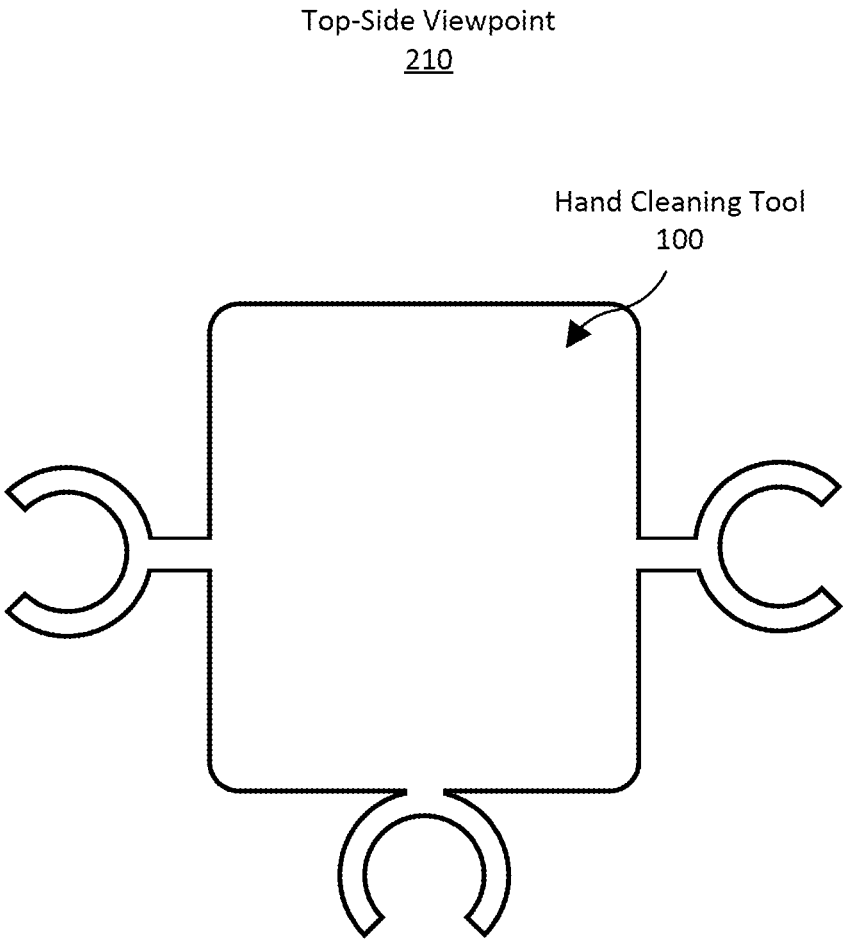
FIG. 2B illustrates a top-side view of the hand cleaning tool from the top-side viewpoint, in accordance with an example embodiment.

FIG. 2B illustrates a top-side view of the hand cleaning tool 100 from the top-side viewpoint 210, in accordance with an example embodiment.

Figure 2C:
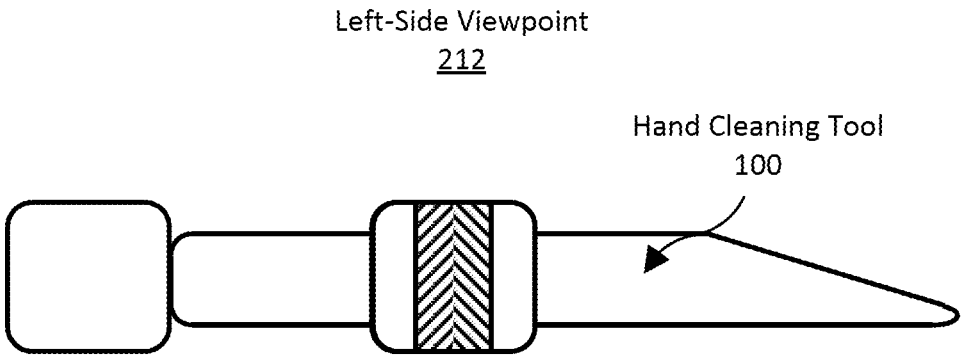
FIG. 2C illustrates a left-side view of the hand cleaning tool from the left-side viewpoint, in accordance with an example embodiment.

FIG. 2C illustrates a left-side view of the hand cleaning tool 100 from the left-side viewpoint 212, in accordance with an example embodiment.

Figure 2D:
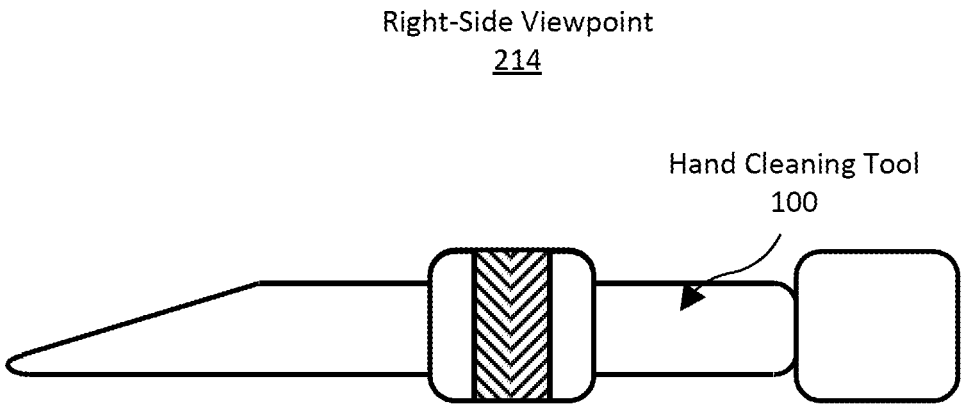
FIG. 2D illustrates a right-side view of the hand cleaning tool from the right-side viewpoint, in accordance with an example embodiment.

FIG. 2D illustrates a right-side view of the hand cleaning tool 100 from the right-side viewpoint 214, in accordance with an example embodiment.

Figure 2E:
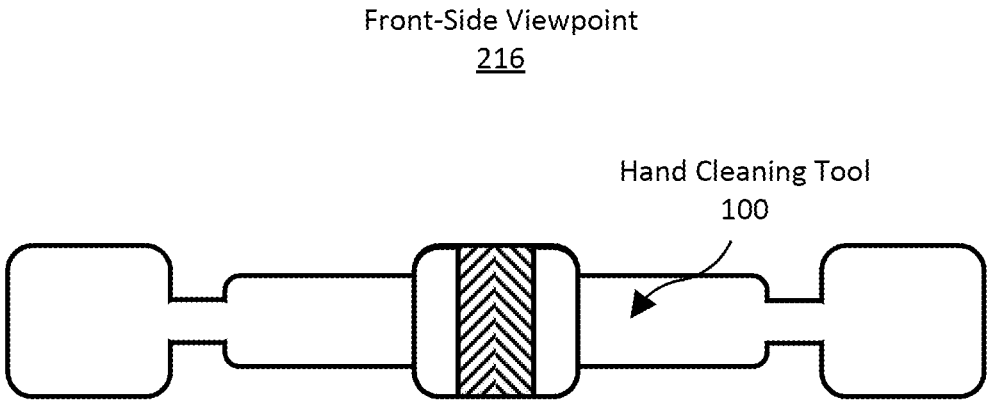
FIG. 2E illustrates a front-side view of the hand cleaning tool from the front-side viewpoint, in accordance with an example embodiment.

FIG. 2E illustrates a front-side view of the hand cleaning tool 100 from the front-side viewpoint 216, in accordance with an example embodiment.

Figure 2F:
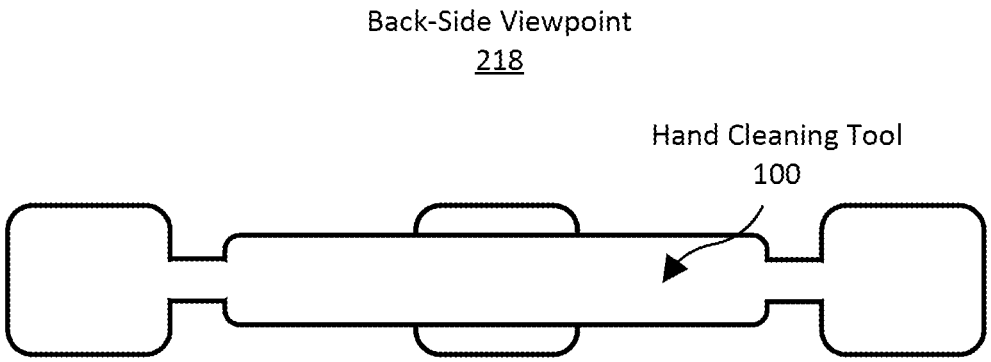
FIG. 2F illustrates a back side view of the hand cleaning tool from the back-side viewpoint, in accordance with an example embodiment.

FIG. 2F illustrates a back side view of the hand cleaning tool 100 from the back-side viewpoint 218, in accordance with an example embodiment.

II.A Example Finger Scrapers

To this point, description of a finger scraper 120 included those formed as a partial circular annulus. However, in various other example configurations, a finger scraper 120 can take other shapes. Typically, the finger scrapers 120 form a partial annulus of some kind (e.g., a geometric shape having an inner wall nearer the center than its outer wall, where the inner and outer walls are similarly shaped), but that need not be the case. FIGS. 3A-5 illustrate several finger scrapers 120 of varying shapes that may include in the hand cleaning tool 100.

Figure 3C:
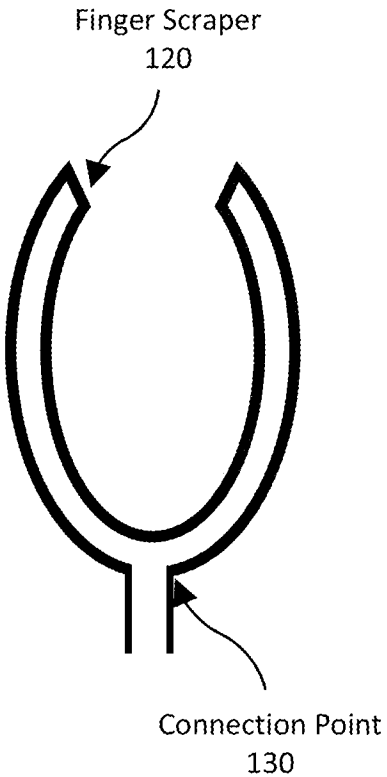
FIGS. 3A-3C illustrate several example finger scrapers shaped as partial rounded annuli, according to several example embodiments.
Figure 3B:
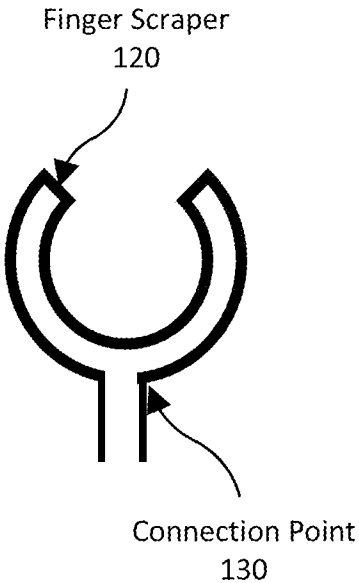
Figure 3A:
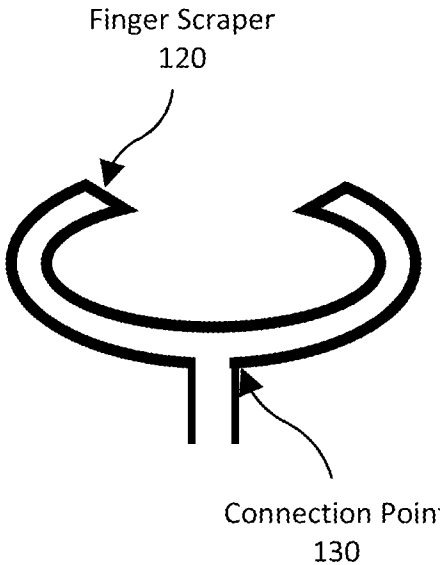

FIGS. 3A-3C illustrate several example finger scrapers shaped as partial rounded annuli, according to several example embodiments. Here, "rounded" indicates that the inner surface and the outer surface do not include straight edges.

FIG. 3A illustrates a finger scraper shaped as a partial rounded annulus whose width is greater than its height (when measured relative to its connection point 130) and having an arc of approximately 260 degrees.

FIG. 3B illustrates a finger scraper 120 shaped as a partial rounded annulus whose width is approximately equal to its height (when measured relative to its connection point 130) and having an arc of approximately 265 degrees.

FIG. 3B illustrates a finger scraper 120 shaped as a partial rounded annulus whose width is approximately equal to its height (when measured relative to its connection point 130) and having an arc of approximately 280 degrees.

Figure 4A:
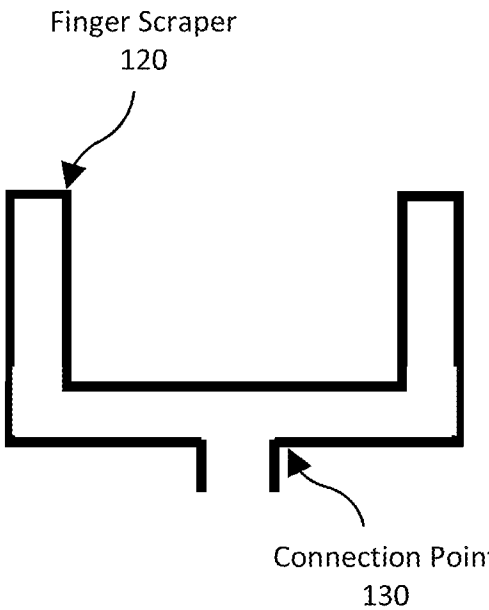
FIGS. 4A-4C illustrate several example finger scrapers shaped as partial angled annuli, according to several example embodiments.
Figure 4B:
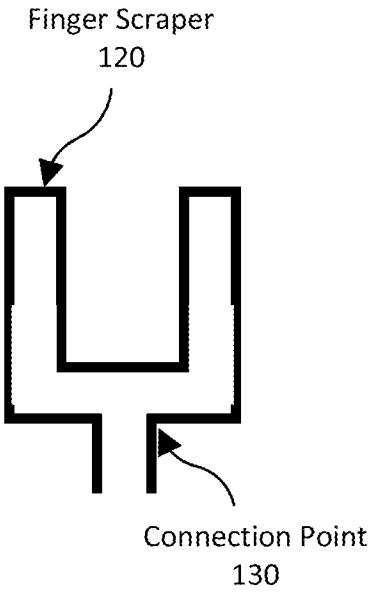
Figure 4C:
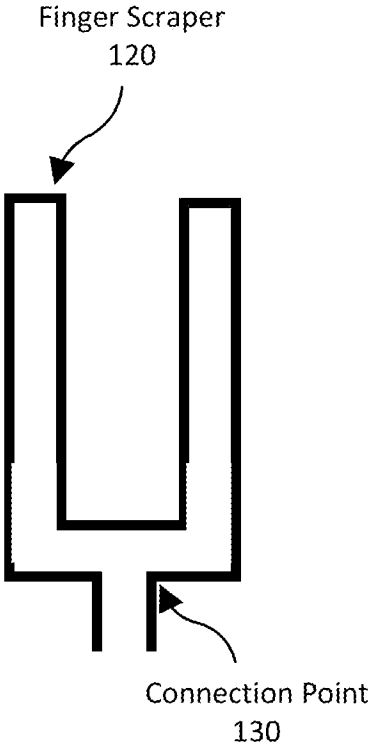

FIGS. 4A-4C illustrate several example finger scrapers 120 shaped as partial angled annuli, according to several example embodiments. Here, "angled" indicates that the inner surface and the outer surface include two or more straight edges that meet at an angle.

FIG. 4A illustrates a finger scraper 120 shaped as a partial angled annulus whose width is greater than its height (when measured relative to its connection point 130) and having an arc of approximately 270 degrees.

FIG. 4B illustrates a finger scraper 120 shaped as a partial angled annulus whose width is approximately equal to its height (when measured relative to its connection point 130), and having an arc of approximately 270 degrees.

FIG. 4C illustrates a finger scraper 120 shaped as a partial angled annulus whose width is less than its height (when measured relative to its connection point 130) and having an arc of approximately 270 degrees.

Figure 5:
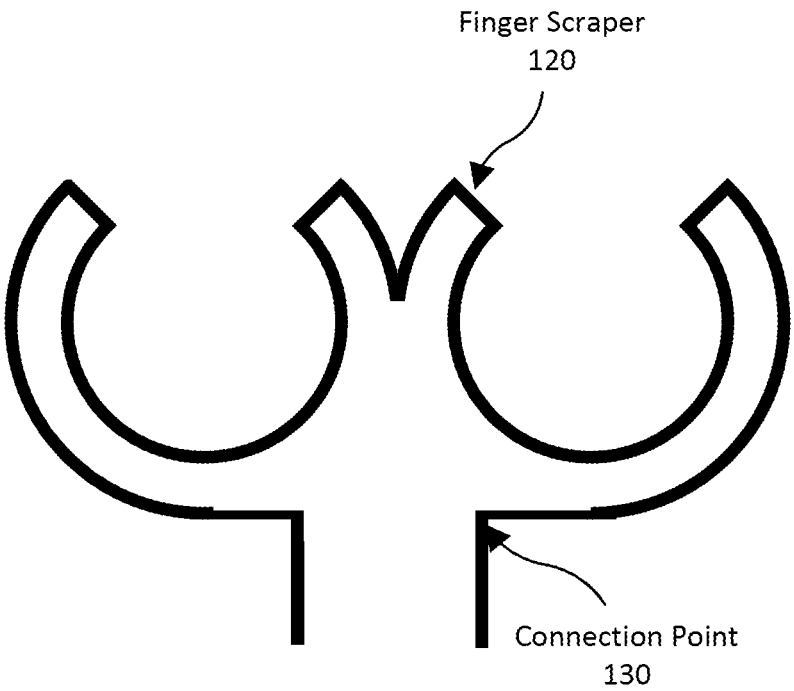
FIG. 5 illustrates a finger scraper shaped as a joined partial rounded annulus, according to one example embodiment.

FIG. 5 illustrates a dual finger scraper 120, according to one example embodiment. A dual finger scraper 120 is a finger scraper 120 formed to include "two" annuli. A dual finger scraper 120 allows for more than one finger scraper 120 to be attached to the tool body 110 at one connection point 130.

II.B Example Hand Cleaning Tool Configurations

The hand cleaning tool 100 can take any number of forms. That is, for instance, the tool body 110 may have different shapes, there may be any number of finger scrapers 120 and there may be any number of connection points 130. The number of finger scrapers is generally one, two, three, four or five, and the number of connection points 130 is equal to or less than the number of finger scrapers 120.

FIGS. 6A-6D illustrate hand cleaning tools 100 with different configurations, according to several different example embodiments.

Figure 6A:
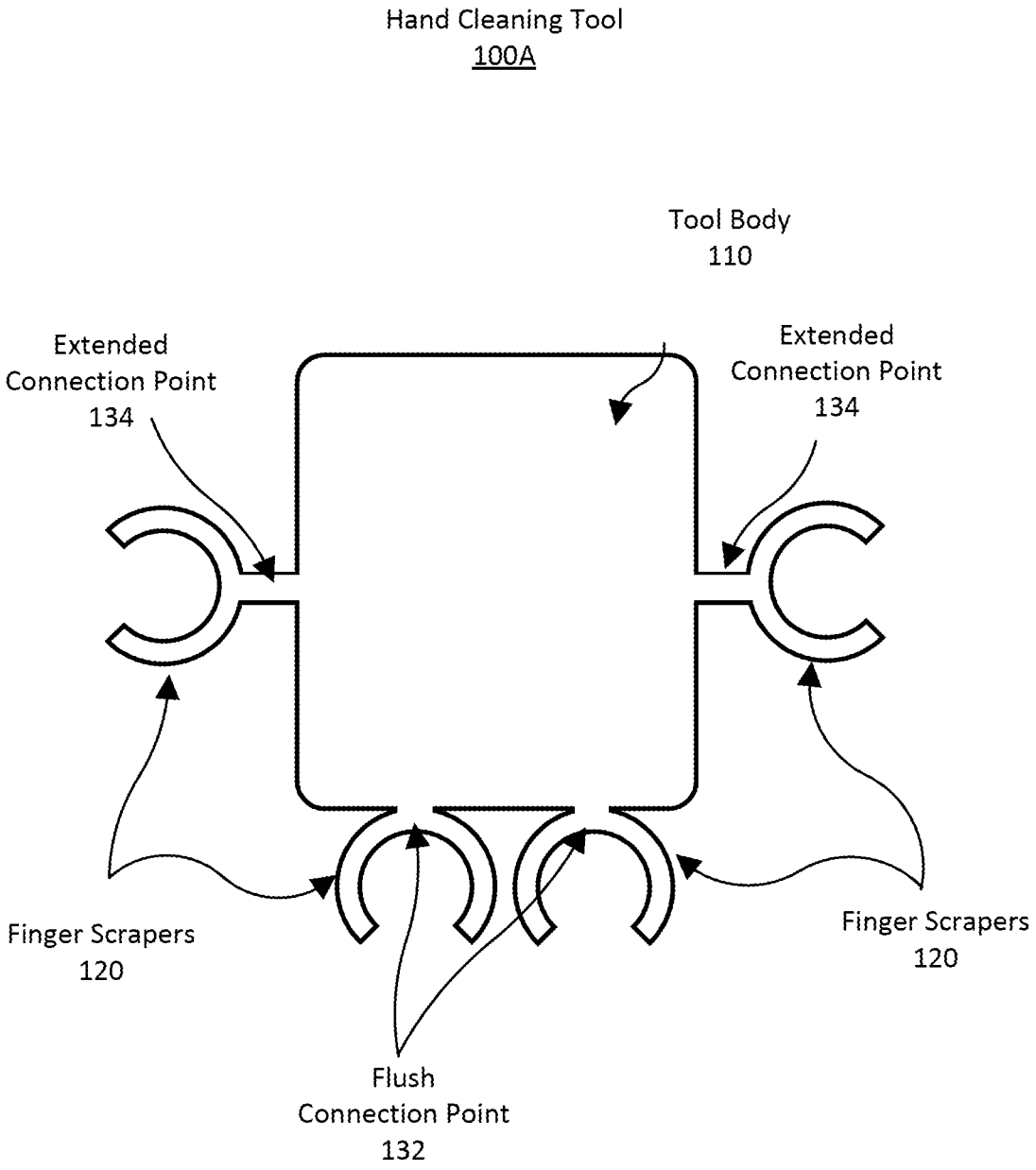
FIGS. 6A-6D illustrate hand cleaning tools with various configurations of finger scrapers, according to several example embodiments.

FIG. 6A illustrates a hand cleaning tool 100A with a rectangular tool body 110, four finger scrapers 120, and four connection points. Two of the four connection points 130 are extended connection points 134 and two of the four connection points are flush connection points 132.

Figure 6B:
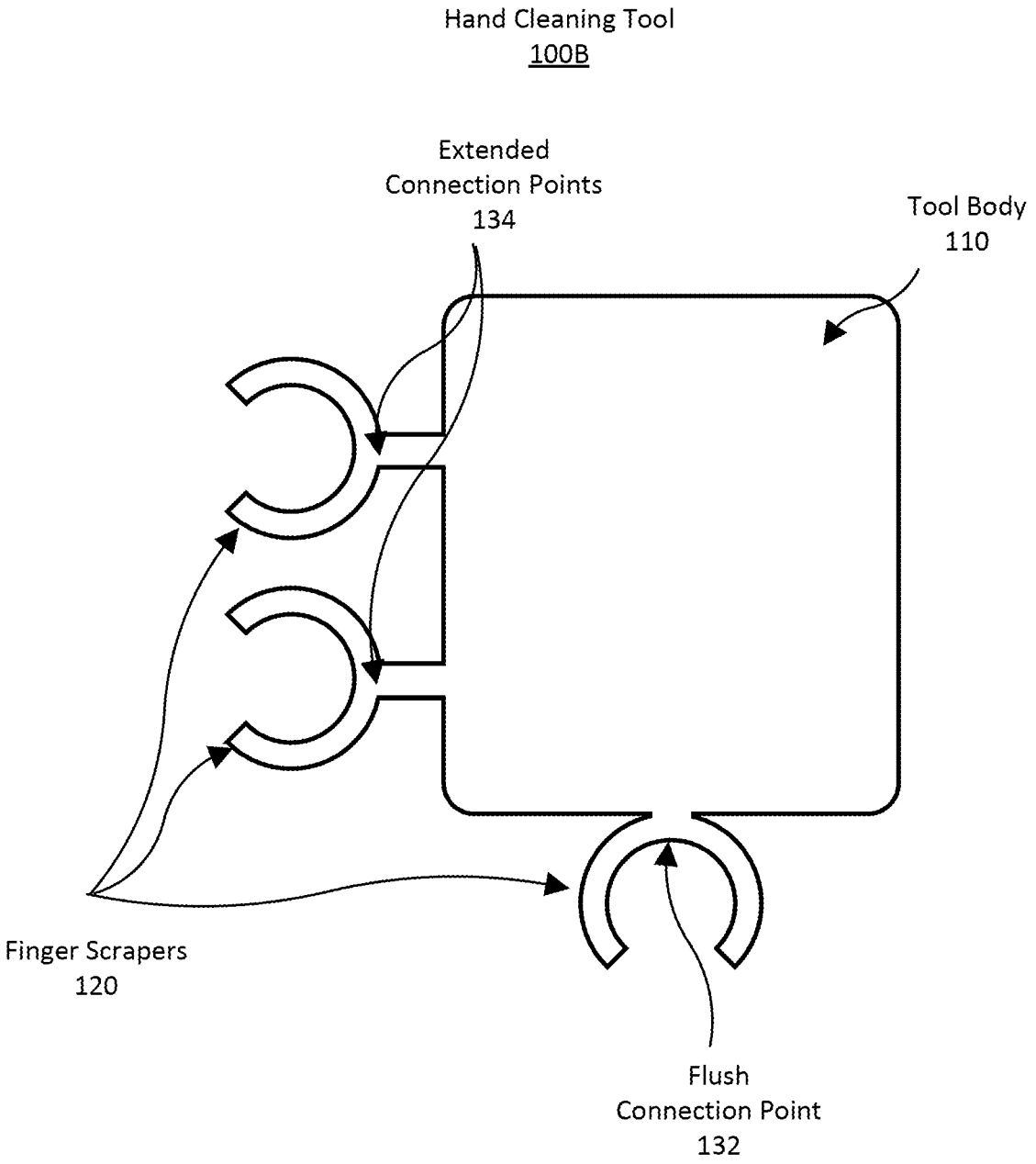

FIG. 6B illustrates a hand cleaning tool 100B with a rectangular tool body 110, three finger scrapers 120, and three connection points. Two of the three connection points 130 are extended connection points 134 and one of the three connection points is a flush connection point 132.

Figure 6C:
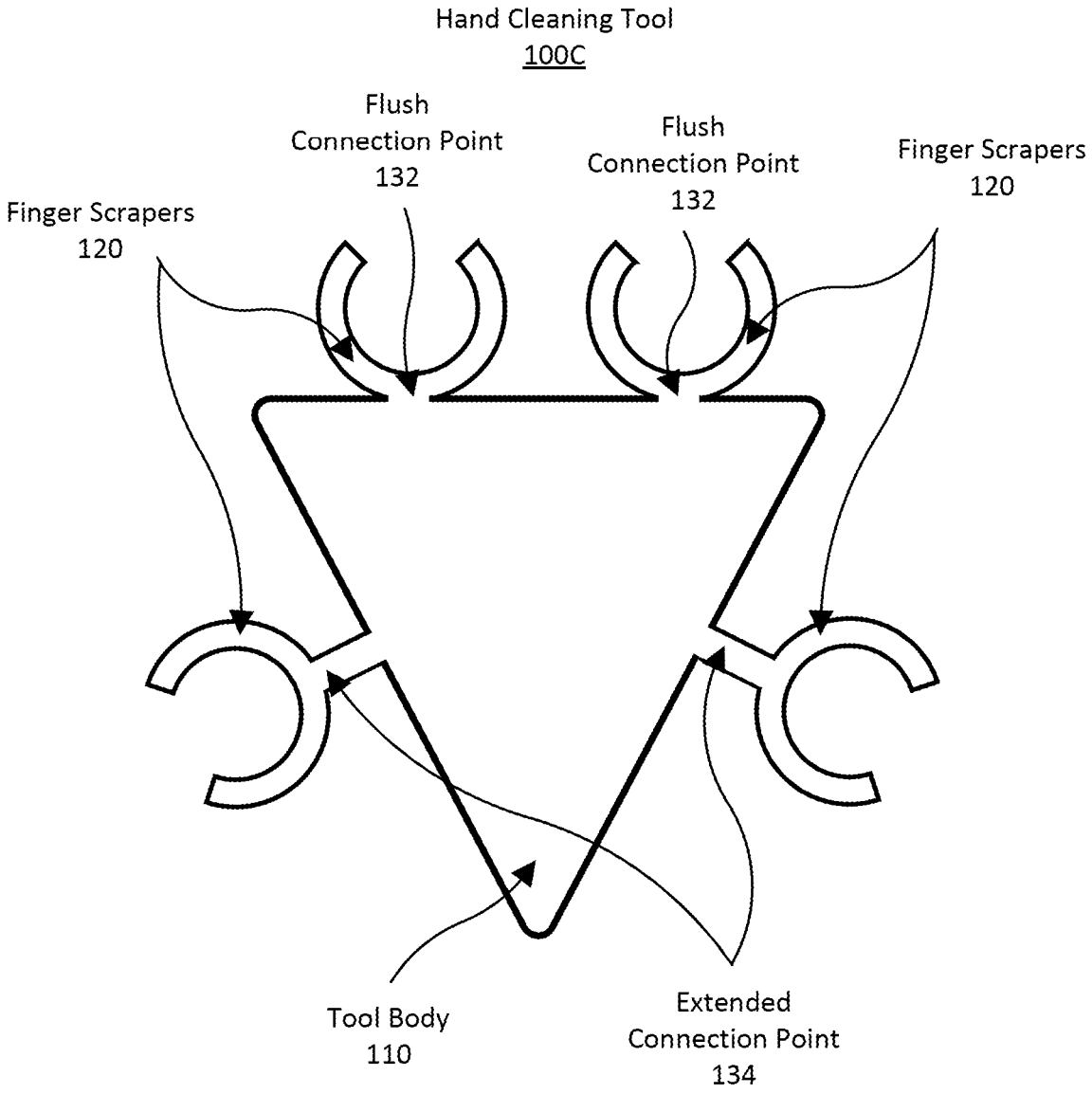

FIG. 6C illustrates a hand cleaning tool 100C with a triangular body, four finger scrapers 120, and four connection points. Two of the four connection points 130 are extended connection points 134 and two of the four connection points are flush connection points 132.

Figure 6D:
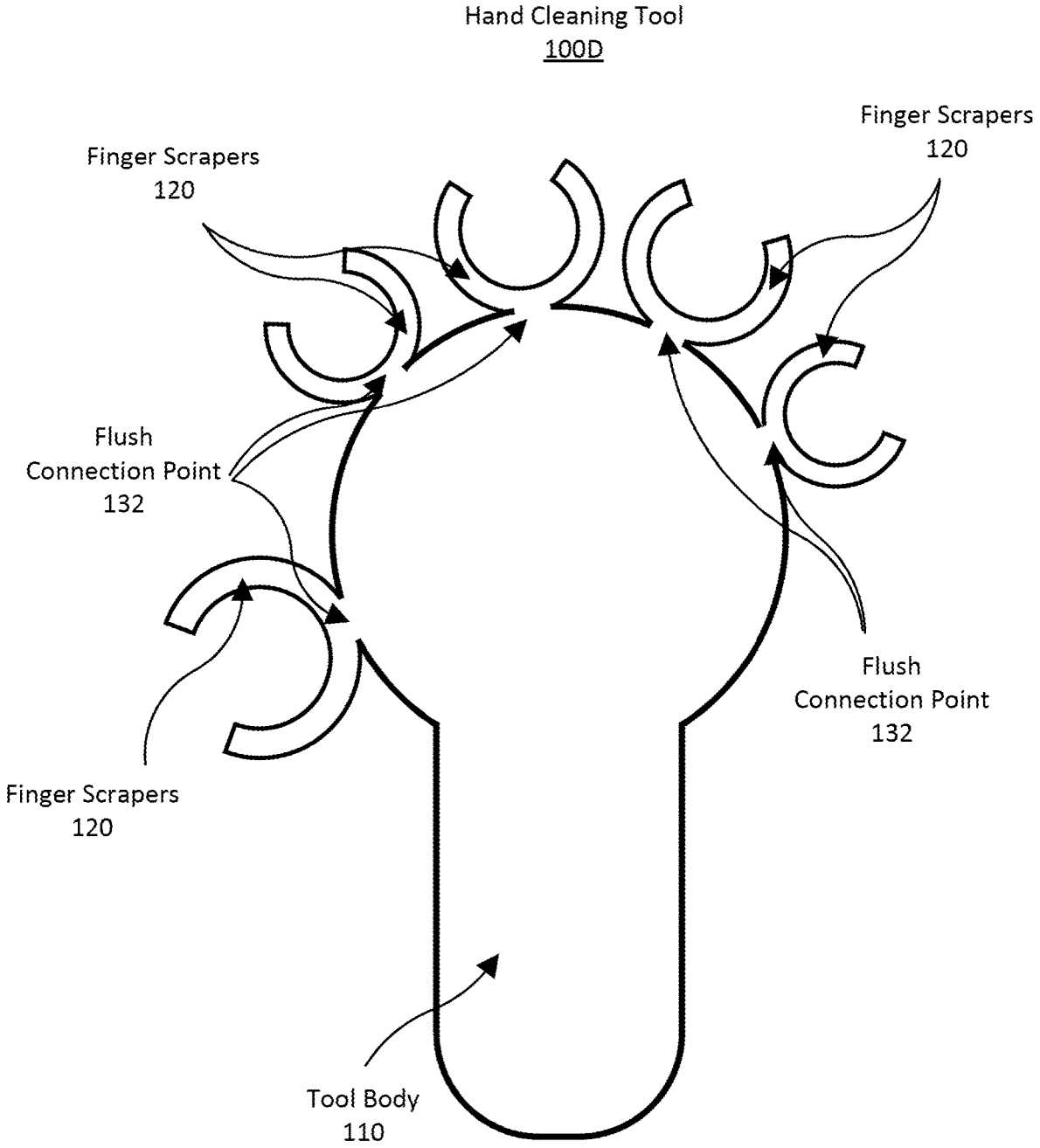

FIG. 6D illustrates a hand cleaning tool 100 with a rounded body, five finger scrapers 120, and five connection points 130. None of the connection points are extended connection points and all are flush connection points 132. Additionally, in this example hand cleaning tool 100, the finger scrapers 120 are different sizes.

FIGS. 6A-6D are just examples, and the hand cleaning tool 100 may take other forms.

III Removably Couplable Finger Scrapers

In some example configurations, the finger scrapers of the hand cleaning tool are adaptable, forming a so-called "adaptable" hand cleaning tool. The adaptability of the hand cleaning tool allows for a wider variety of users to use the hand cleaning tool in a wider variety of manners. For instance, the hand cleaning tool may be adaptable between a "cookie dough" configuration and a "meatloaf" configuration. Similarly, the hand cleaning tool may be adaptable between a "large finger" configuration, and a "small finger" configuration. Or, still further, the hand cleaning tool may be adaptable between a "first material" configuration, and a "second material" configuration. Of course, these are just examples, and the hand cleaning tool may be adaptable in different manners.

Within the context of a hand cleaning tool, "adaptable" means that the finger scrapers 120 of the hand cleaning tool are removably couplable from the tool body 110 at a connection point 130. For convenience, a connection point 130 that allows for removable coupling of a finger scraper 120 will be called a "coupling joint."

Figure 7:
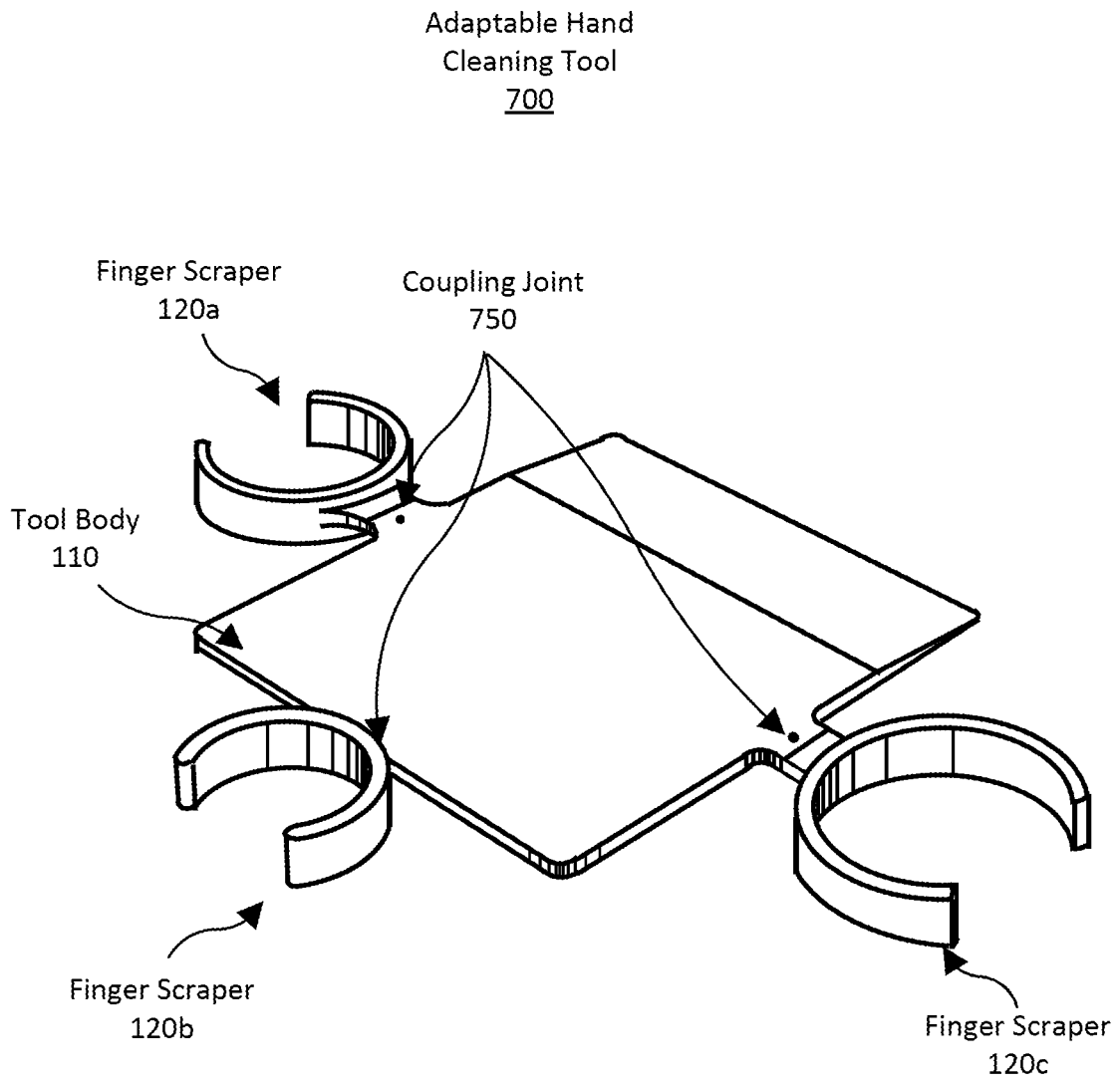
FIG. 7 illustrates a hand cleaning tool including removably couplable finger scrapers 120, in accordance with an example embodiment.

FIG. 7 illustrates an adaptable hand cleaning tool 700 with several coupling joints 750, in accordance with an example embodiment. The adaptable hand cleaning tool 700 includes a tool body and finger scrapers. The tool body and finger scrapers are largely similar to those described hereinabove. Additionally, the finger scrapers of the adaptable hand cleaning tool are removably couplable to the tool body at the coupling joints.

Given this, different finger scrapers 120 suited for different situations may be installed and uninstalled from the adaptable hand cleaning tool 700, as desired, because the finger scrapers 120 are removably couplable to the tool body 110. More explicitly, the finger scrapers 120 are adaptable between a coupled state and a decoupled state. In the couple stated the finger scraper 120 is coupled to the tool body 110, and in the decoupled state the finger scraper 120 is decoupled from the tool body 110. Each of the finger scrapers 120 may be configured to couple to a specific coupling joint 750, or any of the coupling joints.

Generally, a user of the hand scraper applies mechanical forces to the adaptable hand cleaning tool 700 to adapt the hand cleaning tool 700 between one configuration and another. That is, the user may apply mechanical force to a finger scraper 120 coupled to the tool body 110 to decouple the finger scraper 120 from the tool body 110 at a coupling joint. The user may then apply mechanical force to couple a different (or the same) finger scraper 120 to the tool body 110 at the coupling joint.

There are many different types of coupling joints 750, some of which are described and illustrated below.

First Example Coupling Joint

Figure 8A:
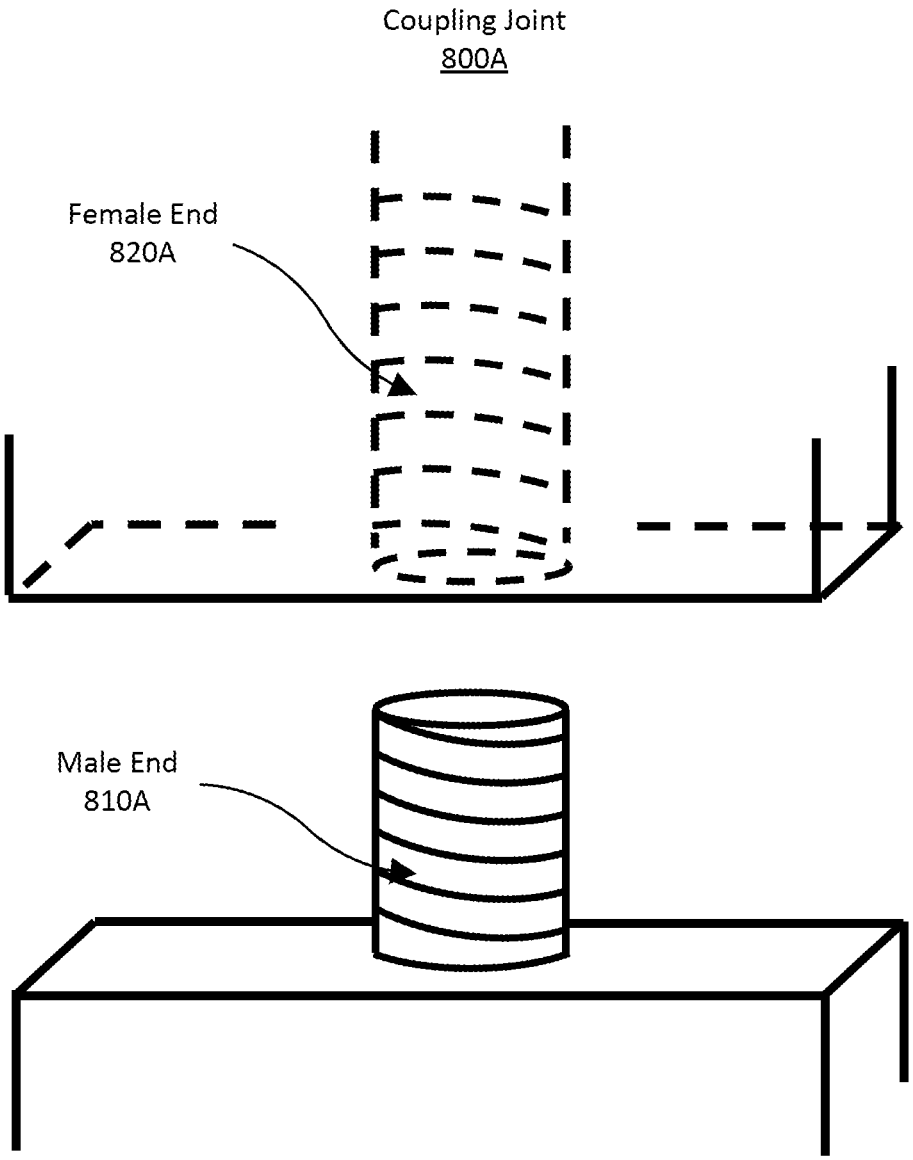
FIG. 8A illustrates an example mechanical attachment mechanism for removably coupling a finger scraper to the body of the hand cleaning tool, according to a first example embodiment.

FIG. 8A illustrates a first example coupling joint 800A of an adaptable hand cleaning tool 700, according to one example embodiment. In this example, the tool body 110 includes the male end of a screw fastener 810A, and the finger scraper 120 includes the female end of screw fastener 820A. In the coupled state the finger scraper 120 is screwed onto the tool body 110, and in the decoupled state the finger scraper 120 is unscrewed from the tool body 110. Of course, in a similar configuration, the finger scraper 120 may include the male end 810A while tool body 110 may include the female end 820A.

Second Example Coupling Joint

Figure 8B:
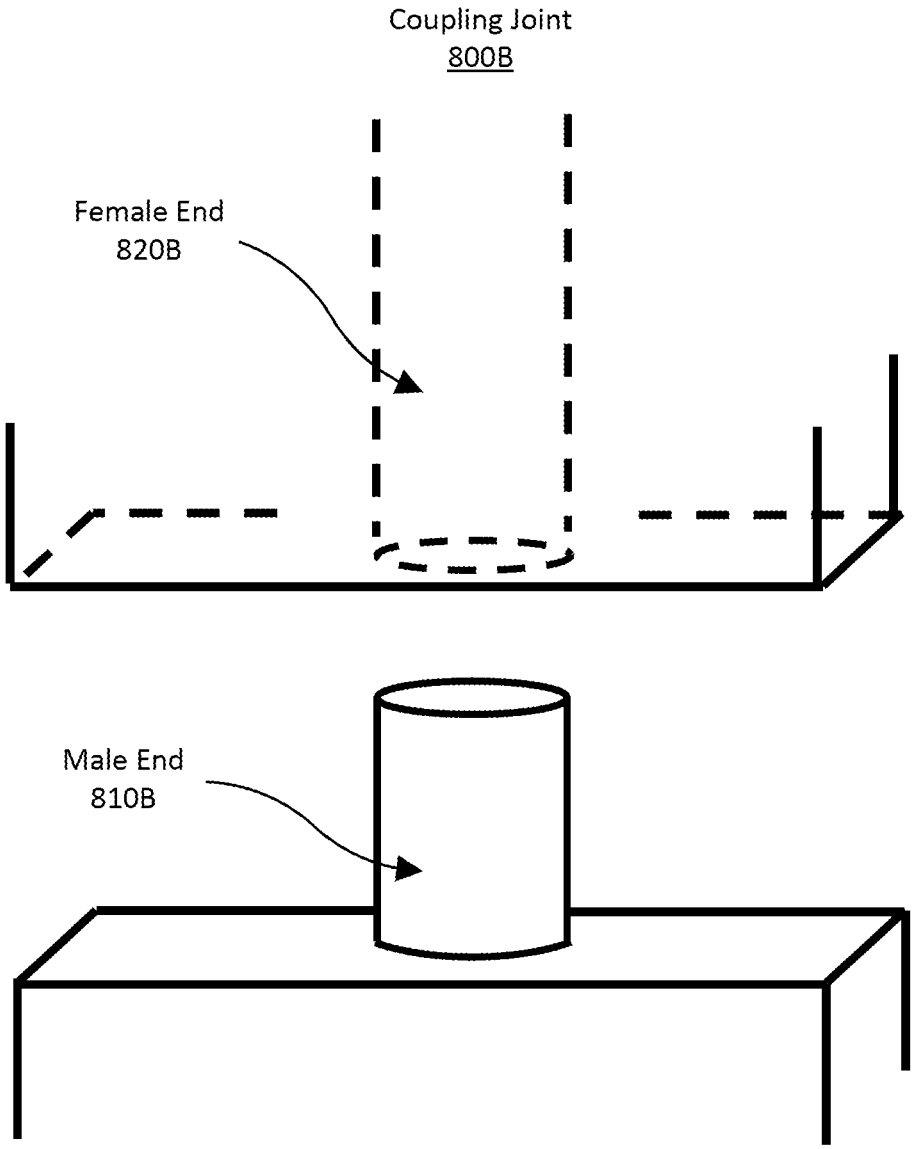
FIG. 8B illustrates an example mechanical attachment mechanism for removably coupling a finger scraper to the body of the hand cleaning tool, according to a first example embodiment.

FIG. 8B illustrates a second example coupling joint 800B of an adaptable hand cleaning tool 700, according to one example embodiment. In this example, the tool body 110 includes the male end of a slot fastener 810A, and the finger scraper 120 includes the female end of a slot fastener 810B. In the coupled state the finger scraper 120 is slotted onto the tool body 110, and in the decoupled state the finger scraper 120 is unslotted from the tool body 110. Of course, in a similar configuration, the finger scraper 120 may include the male end 810B while tool body 110 may include the female end 820B.

Third Example Embodiment

Figure 8C:
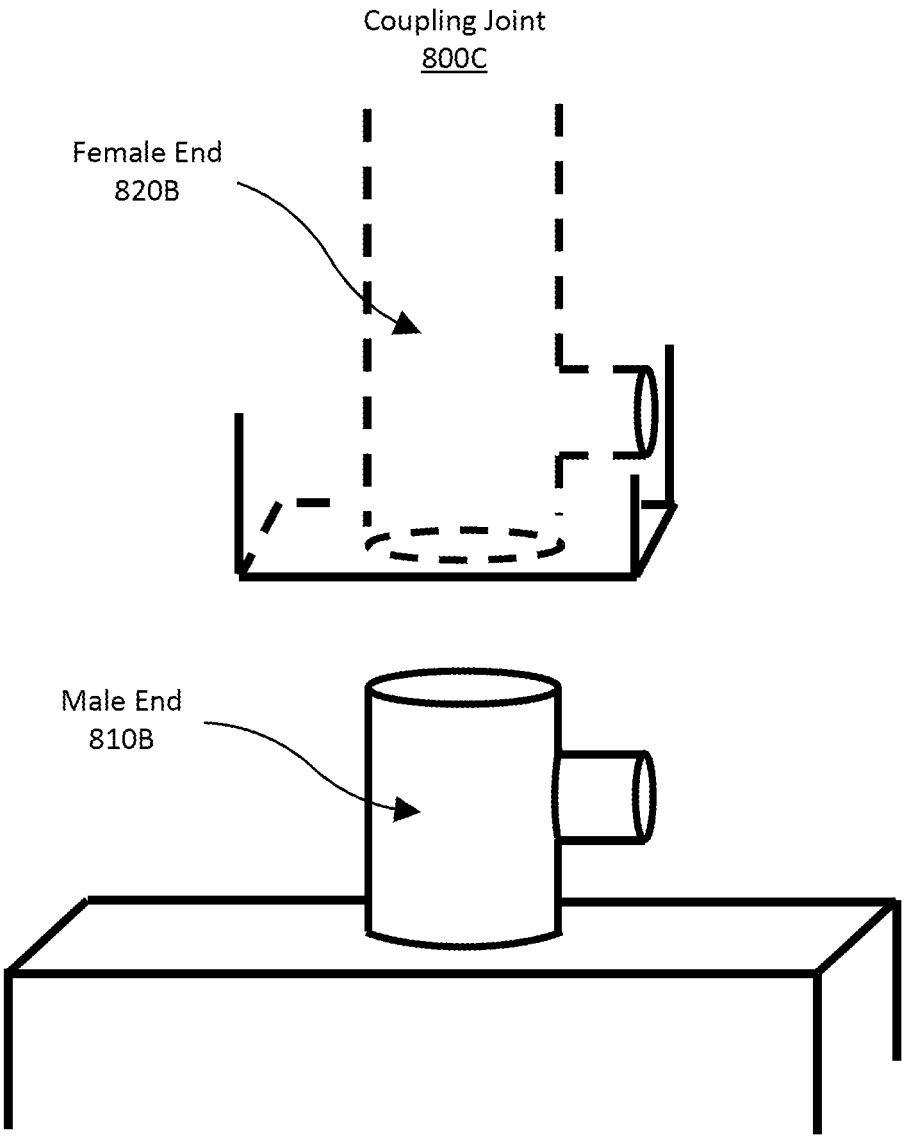
FIG. 8C illustrates an example mechanical attachment mechanism for removably coupling a finger scraper to the body of the hand cleaning tool 100, according to a first example embodiment.

FIG. 8C illustrates a third example of a coupling joint 800C of an adaptable hand cleaning tool 800, according to one example embodiment. In this example, the tool body 110 includes the male end of a compressible via fastener 810C, and the finger scraper 120 includes the female end of a compressible via fastener 820C. In the coupled state the compressible via fastener is coupled to the finger scraper 120 such that the fastener slots into the via, and in the decoupled state the compressible via fastener is decoupled from the tool body 110. Of course, in a similar configuration, the finger scraper 120 may include the male end 810C while tool body 110 may include the female end 820C.

Fourth Example Embodiment

Figure 8D:
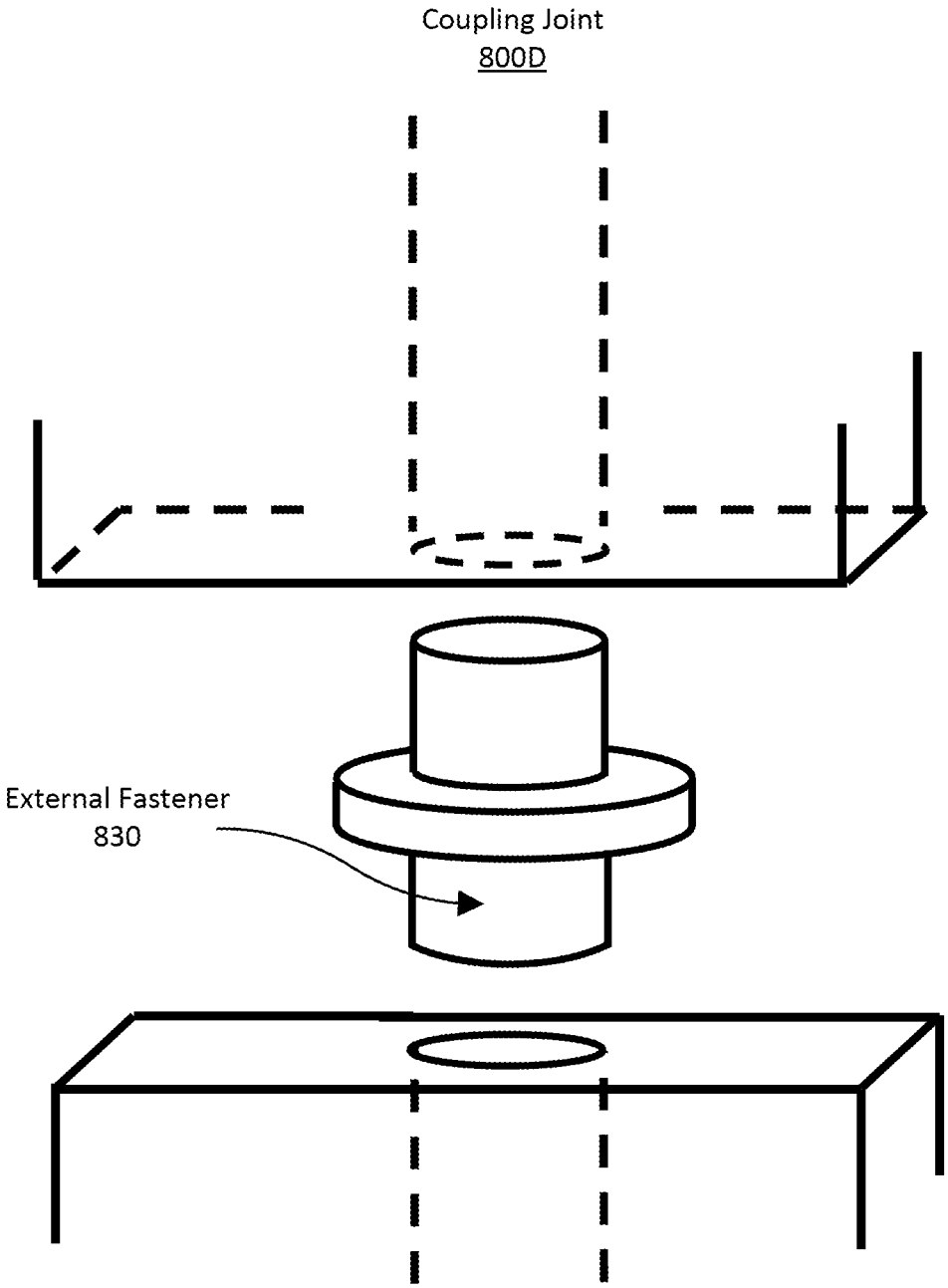
FIG. 8D illustrates an example mechanical attachment mechanism for removably coupling a finger scraper to the body of the hand cleaning tool, according to a first example embodiment.

FIG. 8D illustrates a fourth example of coupling joint 800A of an adaptable hand cleaning tool 800, according to one example embodiment. In this example, the coupling joint utilizes an external fastener 830 to removably couple the tool body 110 and the finger scraper 120. The external fastener 830, in this example, includes two male ends of a slot fastener, and both the finger scraper 120 and the tool body 110 include female ends of the slot fastener. Other external fasteners are also possible.

IV. Method of Use

As described above, the adaptable hand cleaning tool is usable to remove detritus from the operator's hand during kitchen activities.

To do so, a user may obtain a hand cleaning tool (e.g., hand cleaning tool 100). The user may employ the adaptable hand cleaning tool while they are performing various kitchen actions (e.g., baking cookies or making meatloaf). As they are performing the kitchen actions detritus adheres to the user's hands. To remove the detritus, the user takes the adaptable hand cleaning tool by the tool body (e.g., tool body 110) in one hand, and run's the fingers of their opposite hand through the finger scrapers (e.g., finger scrapers 120) of the adaptable hand cleaning tool. The detritus is removed from the user's hands as it either falls off their fingers or accumulates on the hand cleaning tool. The user may clean the detritus from the hand cleaning tool as needed. In instances where the hand cleaning tool is an adaptable hand cleaning tool (e.g., hand cleaning tool 800), the user may modify the configuration of the finger scrapers by, e.g., mechanically coupling and decoupling different configurations of finger scrapers to suit their needs.

V. Additional Considerations

In the description above, for purposes of explanation, numerous specific details are set forth in order to provide a thorough understanding of the illustrated system and its operations. It will be apparent, however, to one skilled in the art that the system can be operated without these specific details. In other instances, structures and devices are shown in block diagram form in order to avoid obscuring the system.

Reference in the specification to "one embodiment" or "an embodiment" or "one configuration" or "a configuration" means that a particular feature, structure, or characteristic described in connection with the embodiment is included in at least one embodiment of the system. The appearances of the phrase "in one embodiment" in various places in the specification are not necessarily all referring to the same embodiment.

The figures and the description above relate to various embodiments by way of illustration only. It should be noted that from the following discussion, alternative embodiments of the structures and methods disclosed herein will be readily recognized as viable alternatives that may be employed without departing from the principles of what is claimed.

One or more embodiments have been described above, examples of which are illustrated in the accompanying figures. It is noted that wherever practicable similar or like reference numbers may be used in the figures and may indicate similar or like functionality. The figures depict embodiments of the disclosed system (or method) for purposes of illustration only. One skilled in the art will readily recognize from the following description that alternative embodiments of the structures and methods illustrated herein may be employed without departing from the principles described herein.

Some embodiments may be described using the expression "coupled" and "connected" along with their derivatives. It should be understood that these terms are not intended as synonyms for each other. For example, some embodiments may be described using the term "connected" to indicate that two or more elements are in direct physical or electrical contact with each other. In another example, some embodiments may be described using the term "coupled" to indicate that two or more elements are in direct physical or electrical contact. The term "coupled," however, may also mean that two or more elements are not in direct physical or electrical contact with each other, but yet still co-operate or interact with each other. The embodiments are not limited in this context.

As used herein, the terms "comprises," "comprising," "includes," "including," "has," "having" or any other variation thereof, are intended to cover a non-exclusive inclusion. For example, a process, method, article or apparatus that comprises a list of elements is not necessarily limited to only those elements but may include other elements not expressly listed or inherent to such process, method, article or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B is true (or present).

In addition, use of the "a" or "an" are employed to describe elements and components of the embodiments herein. This is done merely for convenience and to give a general sense of the system. This description should be read to include one or at least one and the singular also includes the plural unless it is obvious that it is meant otherwise.

What is claimed is:

1. A hand cleaning tool comprising:

a square or rectangular tool body comprising four edges and at least one flat surface, and at least one of the four edges comprises a bevel;

a plurality of connection points, each of the connection points positioned on an edge of the tool body, wherein the at least one beveled tool body edge is free of connection points;

a plurality of finger scrapers extending outwards from the edge of the tool body, each finger scraper of the plurality connected to the tool body at one of the plurality of connection points, and shaped to form a partial annulus, each partial annulus comprising:

an inner surface disposed at an inner radius from a center of the partial annulus, wherein the inner radius of a first finger scraper of the plurality of finger scrapers is a different radius than the inner radius of a second finger scraper of the plurality of finger scrapers, an outer surface disposed at an outer radius from the center of the partial annulus, a finger scraper body formed between the inner surface and the outer surface and forming an arc of the partial annulus, wherein the arc of the partial annulus is at least 180 degrees, and the finger scraper body is coupled to a connection point of the plurality at a midpoint of the arc along the outer surface.

2. The hand cleaning tool of claim 1, wherein the at least one flat surface of the tool body further comprises: a top surface; and a bottom surface.

3. The hand cleaning tool of claim 2, wherein each connection point of the plurality of connection points is disposed at a midpoint of a side surface of the square or rectangular tool body.

4. The hand cleaning tool of claim 1, wherein a thickness of the tool body is at least 3 mm.

5. The hand cleaning tool of claim 1, wherein the arc of a first finger scraper of the plurality of finger scrapers is a different arc than the arc of a second finger scraper of the plurality of finger scrapers.

6. The hand cleaning tool of claim 1, wherein an extended connection point of the plurality of connection points comprises an extension member, the extension member formed to extend the connection point away from the tool body.

7. The hand cleaning tool of claim 6, wherein a finger scraper of the plurality of finger scrapers is connected to the extension member of the extended connection point of the plurality of connection points.

8. The hand cleaning tool of claim 1, wherein the plurality of finger scrapers are removably couplable from the tool body at the plurality of connection points.

9. The hand cleaning tool of claim 1, wherein the plurality of connection points and the plurality of connection points form a coupling joint.

* * * * *